US007323628B2

(12) United States Patent
Ichikawa et al.

(10) Patent No.: US 7,323,628 B2
(45) Date of Patent: Jan. 29, 2008

(54) KEYBOARD MUSICAL INSTRUMENT HAVING TOP BOARD COUPLED WITH ANOTHER BOARD THROUGH MORTISE AND TENON JOINT

(75) Inventors: Tomonori Ichikawa, Shizuoka-ken (JP); Satoshi Inoue, Shizuoka-ken (JP)

(73) Assignee: Yamaha Corporation, Hamamatsu-shi (JP)

( * ) Notice: Subject to any disclaimer, the term of this patent is extended or adjusted under 35 U.S.C. 154(b) by 656 days.

(21) Appl. No.: 10/834,257

(22) Filed: Apr. 29, 2004

(65) Prior Publication Data

US 2004/0216582 A1 Nov. 4, 2004

(30) Foreign Application Priority Data

May 2, 2003 (JP) ..... 2003-127231

(51) Int. Cl.
*G10D 13/02* (2006.01)

(52) U.S. Cl. ..... 84/423 R

(58) Field of Classification Search ..... 84/423 R, 84/424–438, 441, 423 A, 453
See application file for complete search history.

(56) References Cited

U.S. PATENT DOCUMENTS 2,133,368 A * 10/1938 Wallace ..... 248/443
5,588,726 A * 12/1996 Lee ..... 312/263
5,666,778 A * 9/1997 Grattan et al. ..... 52/606
6,180,859 B1 * 1/2001 Konishi ..... 84/174
6,701,984 B2 * 3/2004 Lamontagne et al. ..... 144/347

FOREIGN PATENT DOCUMENTS

| | | |
|---|---|---|
| JP | 55-4468 U | 6/1978 |
| JP | 63-162398 U | 10/1988 |
| JP | 2-119694 U | 9/1990 |
| JP | 9-160538 A | 6/1997 |

OTHER PUBLICATIONS

Gran Touch DGP-2XG, Catalog (Yamaha News Release, Yamaha Piano Home Page: http://www.yamaha.co.jp), Jul. 1997, 2 pages, Yamaha Corporation, Hamamatsu, Japan.
Yamaha Clavinova CLP-555, Catalog (Yamaha News Release, Yamaha Piano Home Page: http://www.yamaha.co.jp/news/1997/97082001.html), Aug. 1997, 1 page, Yamaha Corporation, Hamatsu, Japan.
DGP DUP—Yamaha Electronic Piano, Catalog DGP Series, Sep. 2003, 10 pages, Catalog code PDP309, Yamaha Corporation, Hamamatsu, Japan.

* cited by examiner

*Primary Examiner*—Kimberly Lockett
(74) *Attorney, Agent, or Firm*—Smith Patent Office

(57) ABSTRACT

A front board, side boards and a rear board define the periphery of a cabinet for a keyboard musical instrument; a top board is connected to the front board through a mortise and tenon joint, and is further coupled to rear posts by means of an angle bar and bolts; the tenon is easily inserted into the mortise so as to make the assembling work easy and speedy.

18 Claims, 3 Drawing Sheets

KEYBOARD MUSICAL INSTRUMENT HAVING TOP BOARD COUPLED WITH ANOTHER BOARD THROUGH MORTISE AND TENON JOINT

FIELD OF THE INVENTION

This invention relates to a keyboard musical instrument and, more particularly, to a joint structure for a cabinet of a keyboard musical instrument.

DESCRIPTION OF THE RELATED ART

The keyboard musical instrument is broken down into two categories, i. e., acoustic keyboard musical instruments and electric/electronic keyboard musical instruments. The acoustic keyboard musical instruments have vibratory members such as, for example, strings and pipes, and players give rise to the vibrations through the keyboards. On the other hand, the electric/electronic keyboard musical instruments have electric/electronic circuits, and players instruct the electric/electronic circuits to produce electric signals representative of tones through the keyboards. Thus, the acoustic keyboard musical instruments are different in tone generating mechanism from the electric/electronic keyboard musical instruments. The tone generating mechanisms, which are incorporated in the acoustic keyboard musical instruments and electric/electronic keyboard musical instruments, are hereinafter referred to as "tone generating system".

The tone generating systems are housed in cabinets. The cabinets for the acoustic keyboard musical instruments have classical contours, and the cabinets for the electric/electronic keyboard musical instruments are usually simpler than those for the acoustic keyboard musical instruments are. Nevertheless, most of the cabinets are assembled from lots of boards/panels, blocks, posts, sills and beams. This means that the manufacturers appropriately connect those component parts to one another.

FIG. 1 shows a typical example of the prior art cabinet 1 for an electronic upright piano. In the following description, the word "front" is indicative of a relative position closer to a player who is fingering on the keyboard than another position modified with the word "rear". The direction between a front position and a corresponding rear position is modified with "fore-and-aft", and the fore-and-aft direction crosses the lateral direction at right angle. The prior art electronic upright piano is assumed to stand on a horizontal floor.

The prior art cabinet 1 comprises front posts 2A, rear posts 2B, a pair of side boards 3, a front board 4 and a top board. Though not shown in FIG. 1, a keyboard is mounted on a key bed, and the key bed is supported over the horizontal floor by leg posts. The side boards 3 are vertical to the horizontal floor, and are spaced from each other in the lateral direction. The side boards 3 define both side extents of the cabinet. The key bed and, accordingly, the keyboard are provided between the side boards.

The front board 4 laterally extends between the side boards 3, and is connected to the front ends of the side boards 2 over the rear portion of the keyboard. Thus, the front board 4 defines the front extent of the cabinet 1. The rear posts 2B are vertical to the horizontal floor, and a rear board, which defines the rear extent of the cabinet 1, is reinforced with the rear posts 2B. The front posts 2A are provided inside the cabinet 1 so that the cabinet 1 is further reinforced with the front posts 2A.

The top board 6 is provided over the front and rear posts 2A/2B, and laterally extends between the side boards 3. The top board 6 projects from the rear posts 2B as well as from the front board 4. The top board 6 defines the upper extent of the cabinet 1. A music rack assembly 8 is provided on the top board 7. In this instance, the music rack assembly 8 is constituted by a desk board 8*a* and a back board 9. The desk board 8*a* is secured to the front portion of the top board 6, and has an upper surface, which is rearward sloped. On the other hand, back board 9 is rotatably connected to the top board 6 at the back of the desk board 8*a* by means of a hinge 9*a* so that the back board 9 is foldable onto the desk board 8*a*. When a player wishes to practice the fingering on the keyboard, he or she raises the back board 9, and stands a music score against the back board 9.

The top board 6 is secured to the front and rear posts 2A/2B as follows. An angle bar 7 is secured to the lower surface of the rear portion of the top board 6, and downwardly projects from the rear end of the top board 6. Bolts 5A are vertically screwed through the top board 6 into the front posts 2A, and bolts 5B are frontward screwed into the rear posts 2B through the angle bar 7. The bolt heads 5*a* are left on the top board 6, and are seen by users, who are standing around the electronic upright piano. The bolt heads 5*b* are also left on the angle bar 7. However, the users notice the bolt heads 5*b* less than the bolt heads 5*a*, because the rear portion of the top board 6 hides the bolt heads 5*b* from their view.

The top board 6 is directly pressed to the front posts 2A with the bolts 5A, and the bolts 5A do not permit the top board 6 to move in the fore-and-aft direction. The angle bar 7 is pressed to the rear posts 2B with the bolts 5B, and the bolts 5B do not permit the top board 6 to move in the lateral direction and float over the front and rear posts 2A/2B.

Another prior art cabinet, which is designed for an electronic grand piano, is analogous to the prior art cabinet 1 except that the cabinet is supported by legs. The top board is also secured to the posts by means of bolts.

A problem is encountered in the prior art cabinets in the bolt heads 5*a* are eyesores to the users. Another problem is encountered in the assembling work. The workers secure the top board 6 to the posts 2A/2B as follows. First, the workers put the top board 6 on the front and rear posts 2A/2B. Then, the front posts 2A are hidden below the top board 6, and the workers feel it hard to determine the spots where the bolts 5A are to be driven. The workers previously plot the front posts 2A in a coordinate system, and determine the spots on the top board 6 by using the same coordinate system.

SUMMARY OF THE INVENTION

It is therefore an important object of the present invention to provide a keyboard musical instrument, a cabinet of which is good looking and easy to be assembled.

To accomplish the object, the present invention proposes to assemble a top board with another component member of a cabinet by using a mortise and tenon joint.

In accordance with one aspect of the present invention, there is provided a keyboard musical instrument for generating tones comprising a cabinet formed from a top board defining an upper extent thereof and other component members defining other extents thereof, a keyboard provided on the cabinet and a tone generating system housed in the cabinet and connected to the keyboard for generating the tones, and the top board is connected to at least one of the other component members through a mortise and tenon joint.

BRIEF DESCRIPTION OF THE DRAWINGS

The features and advantages of the keyboard musical instrument will be more clearly understood from the following description taken in conjunction with the accompanying drawings, in which.

DESCRIPTION OF THE PREFERRED EMBODIMENTS

Figure 1:
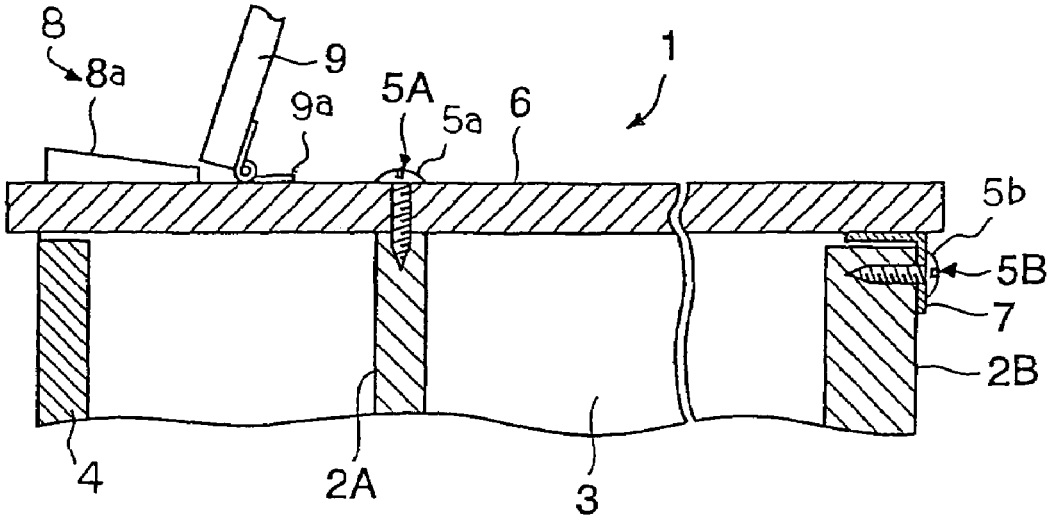
Fig. 1 PRIOR ART
FIG. 1 is a cross sectional side view showing the structure of the prior art cabinet.

A keyboard musical instrument according to the present invention largely comprises a keyboard, a tone generating system and a cabinet. The keyboard includes plural keys independently moved, and pitch names are respectively assigned to the plural keys. The keyboard and, accordingly, the plural keys are connected to the tone generating system for generating tones. While a player is fingering a piece of music on the keyboard, he or she selectively depresses the plural keys, and the tone generating system produces the tones at the pitches equal to those of the pitch names assigned to the depressed keys.

The keyboard is provided on the cabinet, and the tone generating system is housed in the cabinet. In case where the keyboard musical instrument is categorized in the acoustic keyboard musical instrument, the tone generating system includes vibratory component parts, and fingering on the keyboard gives rise to vibrations of the vibratory component parts so that acoustic tones are radiated from the vibrating component parts. On the other hand, if the keyboard musical instrument is categorized in the electric/electronic keyboard musical instrument, the tone generating system is responsive to user's instruction, which is given through the keyboard, for producing an electric signal, and converts the electric signal to electronic tones.

A top board and other component members are assembled into the cabinet. A music rack may be further incorporated in the cabinet. The other component members define the front extent, rear extent and both side extents of the cabinet. The top board defines the upper extent of the cabinet, and is connected to at least one of the other component members through a mortise and tenon joint, i.e., a combination of a mortise and a tenon. Various types of the mortise and tenon joints are available for the cabinet.

The mortise may be bored in the top board or the other component member. Otherwise, a small framework, which defines the mortise, may be secured to the top board or the other component member. The tenon may form a part of the other component member or a part of the top board. Otherwise, the tenon, which was prepared independently, may be secured to the other component member or the top board.

The mortise and tenon may be provided on a butt end of the top board and a corresponding butt end of the other component member. However, the mortise and/or tenon may be spaced from the butt end or ends.

Only a single tenon may be inserted into a single mortise, or plural mortise and tenon joins may be prepared for the top board and other component member.

The tenon may be parallelepipedic. In this instance, two pairs of parallel inner surfaces define the mortise. Another tenon and corresponding mortise may be a wedge-shaped or have a dovetail cross-section.

The mortise and tenon joint prohibits the top board from at least chattering in the up-and-down direction. The mortise and tenon joint may further prohibit the top board from offset from the other component member. However, the mortise and tenon joint can not resist against the force, which is exerted on the top board in the direction reverse to the insertion. A countermeasure is required for the undesirable force. The top board may be further secured to yet another component member of the cabinet against the undesirable force. An angle bar and bolts are available for the coupling between the top board and yet another component member. However, the angle bar and bolts do not set any limit to the technical scope of the present invention. Stud bolts and nuts may be used between the top board and yet another component member. The top board and yet another component member may be coupled to each other by means of a toggle joint.

The mortise and tenon join is desirable for the cabinet, because any bolt head is left on the upper surface of the top board. Furthermore, the mortise and tenon joint make the assembling work easy and speedy. An assembling worker firstly aligns the tenon with the mortise, and, thereafter, pushes the top board toward the other component member so as to insert the tenon into the mortise. While the assembling worker is aligning the tenon with the mortise, the top board is still spaced from the other component member, and permits the assembling worker to seek the best position for the alignment between the mortise and the tenon. When the assembling worker finds the best position, he or she is only expected to push the tenon into the mortise. Thus, the mortise and tenon joint is preferable to the bolts 5A.

First Embodiment

Figure 2:
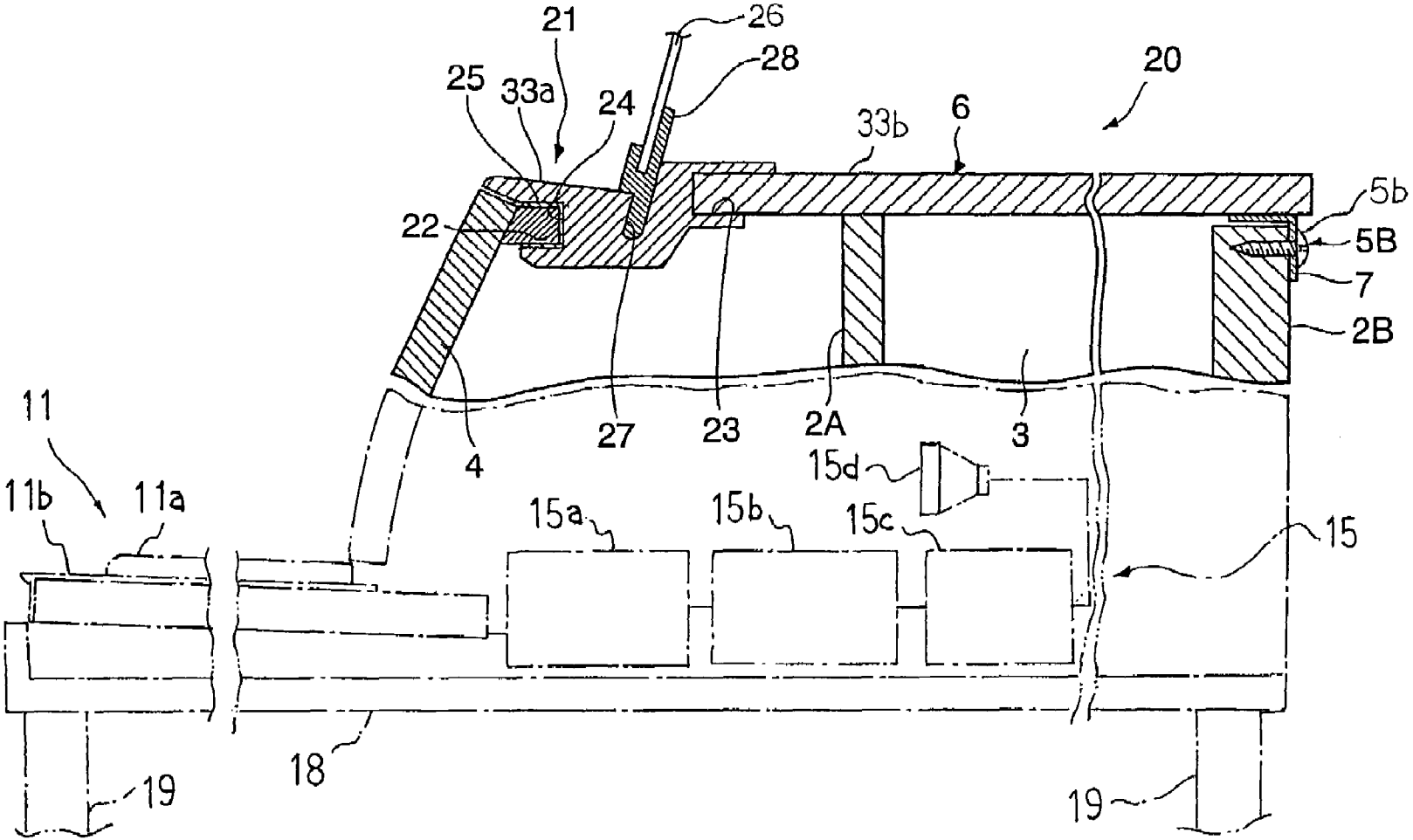
FIG. 2 is a cross sectional side view showing the structure of an electronic grand piano according to the present invention.

Referring to FIG. 2 of the drawings, an electronic grand piano embodying the present invention largely comprises a keyboard 11, an electronic tone generating system 15 and a cabinet 20. The keyboard 11 is provided on a front terrace of the cabinet 20, and the electronic tone generating system 15 is housed in the cabinet 20. The keyboard 11 is connected to the electronic tone generating system 15, and a player instructs the electronic tone generating system 15 to generate electronic tones through a fingering on the keyboard 11.

The keyboard 11 includes plural black keys 11*a* and plural white keys 11*b*. The black keys 11*a* and white keys 11*b* are laid on the well-known pattern, and are independently moved. Pitch names are respectively assigned to the black/white keys 11*a*/11*b* so that a player specifies the pitches of the electronic tones to be generated through the keyboard 11.

The electronic tone generating system 15 is connected to the key switch circuit 15*a*, and includes a key switch circuit 15*a*, a tone generator unit 15*b*, amplifiers 15*c* and loud speakers 15*d*. The key switch circuit 15*a* has plural switches, and a player selectively open and close the switches by manipulating the black/white keys 11*a*/11*b*. The tone generator unit 15*b* includes a microprocessor, a program memory, a working memory and a tone generator. The microprocessor runs on a main routine program, and the main routine program periodically branches to sub-routine programs. While the microprocessor is reiterating the main/sub-routine programs, the microprocessor fetches pieces of key state data representative of note-on/note-off state, and instructs the tone generator to control an audio signal for the electronic tones to be generated or decayed. The audio signal is equalized and amplified through the amplifiers 15*c*, and is converted to the electronic tones through the loud speakers 15*d*. The tone generator unit is well known to persons skilled in the art, and no further description is hereinafter incorporated for the sake of simplicity.

The cabinet 20 includes front posts 2A, rear posts 2B, a pair of side boards 3, a front board 4, a top board 6, a key bed 18 and legs 19. The key bed 18 partially serves as the front terrace, and the keyboard 11 is mounted thereon. Circuit boards, on which the system components of the electronic tone generating system 15 are integrated, are further mounted on the key bed 18. Plural legs downwardly project from the key bed 18, and keep the keyboard 11 over a floor.

The side boards 3 are upright on both sides of the key bed 18, and define both side extents of the cabinet 20. The front board 4 laterally extends over the keyboard 11, and is secured at both sides thereof to the side boards 3. Though not shown in FIG. 2, a rear panel laterally extends between the rear ends of the side boards 3, and is secured at both sides thereof to the side boards 3. The rear panel is reinforced with the rear posts 2B. The front board 4, side boards 3, rear panel and rear posts 2B define the periphery of the cabinet 20, and the electronic tone generating system 15 is enclosed with those boards 3/4 and posts 2B. Thus, the front board 4, side boards 3, rear panel and rear posts 2B serve as the other component members.

The front posts 2A are provided inside the cabinet 20, and upwardly project from the key bed 18. The front posts 2A are as high as the rear posts 2B and side boards 3, and the front posts 2A and rear posts 2B support the top board 6. The top board 6 has the width approximately equal to the distance between the outer surfaces of the side boards 3, and is secured to the side boards 3. The top board 6 is further connected at the front end to the front board 4 by means of a mortise and tenon joint 21 and at the rear end to the rear posts 2B by means of an angle bar 7 and bolts 5B. Thus, the upper opening of the cabinet 15 is closed with the top board 6 so that the top board 6 defines the upper extent of the cabinet 20.

A desk board 33*a* and a rear board 33*b* form in combination the top board 6. The desk board 33*a* laterally extends between the side boards 3, and is formed with a groove 27. The groove 27 laterally extends, and a socket 28 is snugly received in the groove 27. The socket 28 has an upper portion, which is bifurcated in such a manner as to hold a back board 26 stable therein. A player stands a music score (not shown) against the back board 26. Thus, the desk board 33*a*, socket 28 and back board 26 as a whole constitute a music rack. The length of the groove 27 is greater than the width of the back board 26 is. For this reason, a user can move the socket 28 and, accordingly, the music score on the back board 26 to a suitable position on the desk board 33*a*. The socket 28 and the groove 27 are so simple that the manufacturer can reduce the number of the component parts of the music rack and, accordingly, the production cost.

The rear board 33*b* laterally extends between the side boards 3 at the back of the desk board 33*a*, and is coupled with the desk board 33*a*. A lateral groove 23 is formed in the rear portion of the desk board 33*a*, and is rearward open. The rear lateral groove 23 has a height approximately equal to the thickness of the front portion of the rear board 33*b* so as snugly to receive the front portion of the rear board 33*b*. The rear board 33*b* is adhered to the inner surfaces, which define the lateral groove 23. Otherwise, the rear portion of the desk board 33*a* is secured to the front portion of the rear board 33*b* by means of small bolts, which are upwardly screwed from the lower surface of the desk board 33*a* into the front portion of the rear board 33*b*. For this reason, even if the desk board 33*a* is secured to the rear board 33*b* through the small bolts, the bolt heads are not seen on the upper surface of the top board 6.

An angle bar 7 laterally extends beneath the rear portion of the rear board 33*b*, and is secured to the lower surface of the rear portion. Bolts 5B are screwed through the angle bar 7 into the rear posts 2B so that the rear board 33*b* is anchored at the rear posts 2B by means of the angle bar 7 and bolts 5B. The angle 7 and bolts 5B prohibit the rear board 33*b* from rearward motion, and prevents the top board 6 from separation from the front board 4. The angle 7 and bolts 5B are further effective against the force exerted on the top board 6 in the lateral direction. Since the angle bar 7 is slightly retracted from the rear end surface of the rear board 33*b*, the bolt heads 5*b* are hidden below the rear portion of the rear board 33*b*. For this reason, the bolts 5B are not eyesores.

The desk board 33*a* is further coupled to the front board 4 by means of the mortise and tenon joint 21. The mortise and tenon joint 21 keeps the top board 6 against the force exerted on the top board 6 in the up-and-down direction. Any bolt is not required for the assemblage between the to board 6 and the front board 4. This results in fine appearance.

Description is hereinafter focused on the mortise and tenon joint 21. The mortise and tenon joint 21 includes a tenon 22, a front portion of the desk board 33*a* formed with a mortise 24 and a filler 25. The tenon 22 rearward projects from the rear surface of the front board 4, and is inserted into the mortise 24. The gap between the tenon 22 and the inner surfaces, which define the mortise 24, is filled with the filler 25 so that the filler 25 prevents the tenon 22 from chattering in the mortise 24.

In the assembling work, an assembling worker puts the rear board 33*b* on the upper surfaces of the front posts 2A, and makes the mortise 24 aligned with the tenon 22. When the mortise 24 is aligned with the tenon 22, the assembling worker frontward pushes the top board 6 so as to insert the tenon 22 into the mortise 24 for coupling the top board 6 with the front board 4. The rear board 33*b* slides on the front posts 2A, and the tenon 22 is received in the mortise 24. While the assembling worker is looking for the alignment between the tenon 22 and the mortise 24, the front board 4 is spaced from the desk board 33*a*, and permits the assembling worker to see the position of the tenon 22 through the gap. Thus, the mortise and tenon joint 21 makes the assembling work easy and speedy.

The tenon 22 was prepared independently of the front board 4, and is made of synthetic resin, light metal, light metal alloy such as aluminum alloy or wood. In this instance, two pairs of flat surfaces and a rearmost end surface define the tenon 22 so that the tenon 22 has a rectangular parallelepiped configuration. The flat surface of each pair are in parallel to each other. The tenon 22 laterally extends between both sides of the front board 4, and the mortise 24 also extends between both sides of the desk board 33*a*. In other words, the tenon 22 is equal in width to the mortise 24. The tenon 22 has the length and thickness approximately equal to the depth and height of the mortise 24. The filler 25 is made of felt, cloth or artificial leather, and is adhered to the inner surfaces of the desk board 33*a*. For this reason, the filler 25 makes the mortise 24 keep the tenon 22 in the close fitting.

As will be understood from the foregoing description, the top board 6 is coupled with the other component of the cabinet 20 through the mortise and tenon joint 21, and any bolt is not required for the coupling between the top board 6 and the other component. This results in the fine appearance. Moreover, the tenon 22 is inserted into the mortise 24 through the horizontal motion of the top board 6. The alignment is required for the tenon 22 and mortise 24, and is achieved before the assembling worker inserts the tenon 22 into the mortise 24. For this reason, the assembling worker can see the relative position between the tenon 22 and mortise 24 through the gap between the top board 6 and the other component, and, for this reason, easily aligns the tenon 22 with the mortise 24 speedy.

Second Embodiment

Figure 3:
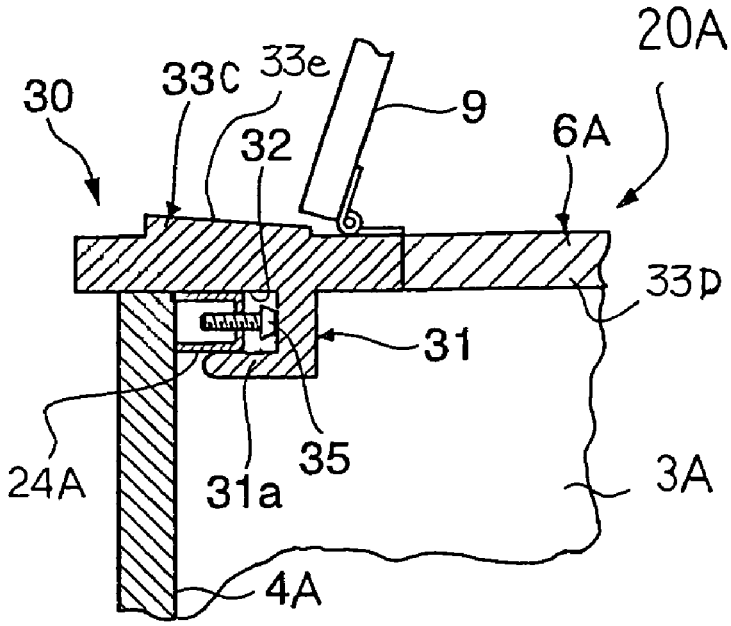
FIG. 3 is a cross sectional view showing the structure of a mortise and tenon joint incorporated in another keyboard musical instrument according to the present invention.

Turning to FIG. 3 of the drawings, a small-sized acoustic upright piano embodying the present invention largely comprises a keyboard (not shown), a tone generating system, which includes action units, hammers and strings, and a piano cabinet 20A. The keyboard and tone generating system are well known to persons skilled in the art, and no further description is hereinafter incorporated for the sake of simplicity.

The piano cabinet 20A includes a front board 4A, a pair of side boards 3A, a top board 6A, a rear panel (not shown) and posts (not shown). Although the piano cabinet 20A further includes other boards, they are not shown in FIG. 3. The front board 4A defines a part of the front extent of the piano cabinet 20A, and the rear panel (not shown) defines the rear extent of the piano cabinet 20A. The pair of side boards 3A defines the side extent of the piano cabinet 20A. Thus, the front board 4A, rear panel (not shown) and side boards 3A define part of the periphery of the piano cabinet 20A. The inner space defined in the piano cabinet 20A is open to the environment through an upper opening.

The upper opening is closed with the top board 6A, and the top board 6A defines the upper extent of the piano cabinet 20A. The top board 6A includes a desk board 33C and a rear board 33D. The desk board 33C is connected to the rear board 33D by means of a suitable coupling device. A mortise and tenon joint may be employed as the coupling device. Otherwise, a butt joint or a suitable hinge may be used between the desk board 33C and the rear board 33D. The rear board 33D is anchored at the rear panel or post by means of another suitable coupling. The coupling between the rear board 33D and the rear panel does not permit the top board 6A unintentionally to move in the rearward direction.

The desk board 33C has a sloped surface 33*e*, which is rearward inclined, and a back board 9 is hinged to the upper surface of the desk board 33C at the back of the sloped surface 33*e*. A pianist stands a music score (not shown) against the back board 9, and the sloped surface 33*e* prevents the music score from slipping down on the desk board 33C.

The desk board 33C is coupled with the front board 4A by means of a mortise and tenon joint 30. The desk board 33C is formed with a socket 31. The socket 31 projects from the lower surface of the desk board 33C, and defines a mortise 32. The mortise 32 is frontward opened. A tenon 24A is secured to the rear surface of the front board 4A. The tenon 24A is shaped like a channel, and an adjuster 35 is screwed into and out of the tenon 24A. Thus, a worker can change the length from the rear surface of the front board 4A to the head thereof by screwing the adjuster 35 into and out of the tenon 24A. The thickness of the tenon 24A is approximately equal to the height of the mortise 32 so that the tenon 24A is snugly received in the mortise 32. The desk board 33C is overhung from the front surface of the front board 4A. A worker can regulate the length of the overhung by screwing the adjuster 35 into and out of the tenon 24A.

When the top board 6A is assembled with the front board 4A, an assembling worker aligns the tenon 24A with the mortise 32, and frontward pushes the top board 6A so as to insert the tenon 24A into the mortise 32. The head of the adjuster 35 is brought into contact with the bottom surface of the socket 31. Then, the assembling worker stops the top board 6A, and anchors the rear board 33D at the rear panel or posts.

The mortise and tenon joint 30 achieves all the advantages of the mortise and tenon joint 21. Moreover, the adjuster 35 makes the overhang regulable. In other words, even if the length of the tenon 24A or the depth of the mortise 32 is different from those in the design specification, the manufacturer can assemble the top board 6A with the front board 4A through the mortise and tenon joint 30.

Third Embodiment

Figure 4:
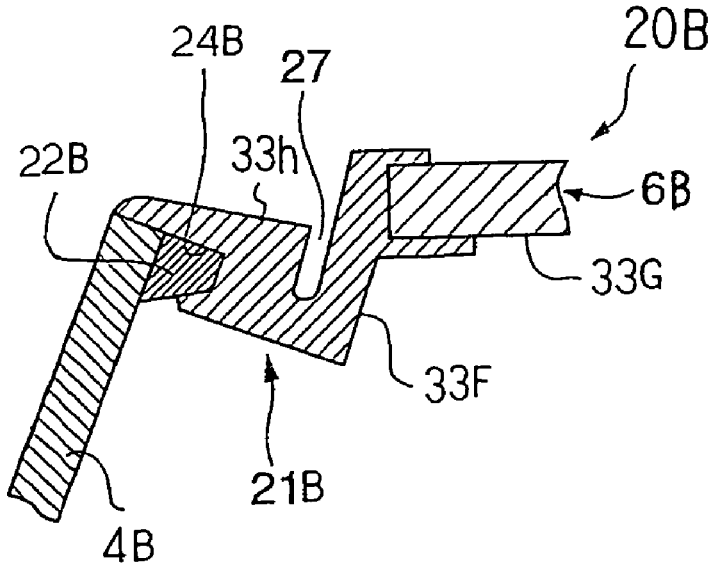
FIG. 4 is a cross sectional view showing the structure of another mortise and tenon joint incorporated in yet another keyboard musical instrument according to the present invention.

Turning to FIG. 4 of the drawings, an electronic grand piano embodying the present invention largely comprises a cabinet 20B, a keyboard (not shown) and a tone generating system (not shown). The keyboard and tone generating system are similar to those of the electronic grand piano implementing the first embodiment, and no further description is hereinafter incorporated for avoiding undesirable repetition.

The cabinet 20B is formed from the boards as similar to the cabinet 20 except for a mortise and tenon joint 21B. The top board 6B includes a desk board 33F and a rear board 33G, and the desk board 33F is bent so that a sloped upper surface 33*h* takes place. The mortise and tenon joint 21B is different from the mortise and tenon joint 21 in that the cross section is trapezoidal. The other features are similar to those of the mortise and tenon joint 21.

The mortise and tenon joint 21B includes a tenon 22B and a front end portion of the desk board 33F formed with a mortise 24B. The mortise 24B is formed in the front end portion of the desk board 33F, and the tenon 22B rearward project from the rear surface of the front board 4B. The cross section of the mortise 24B is slightly narrower than the cross section of the rearmost surface of the tenon 22B. When the top board 6B is forwardly pressed toward the front board 4B, the tenon 22B is tightly pressed to the inner surfaces defining the mortise 24B. For this reason, the tenon 22B is not chattered in the mortise 24B.

The mortise and tenon joint 21B achieves all the advantages of the mortise and tenon joint 21.

Fourth Embodiment

Figure 5:
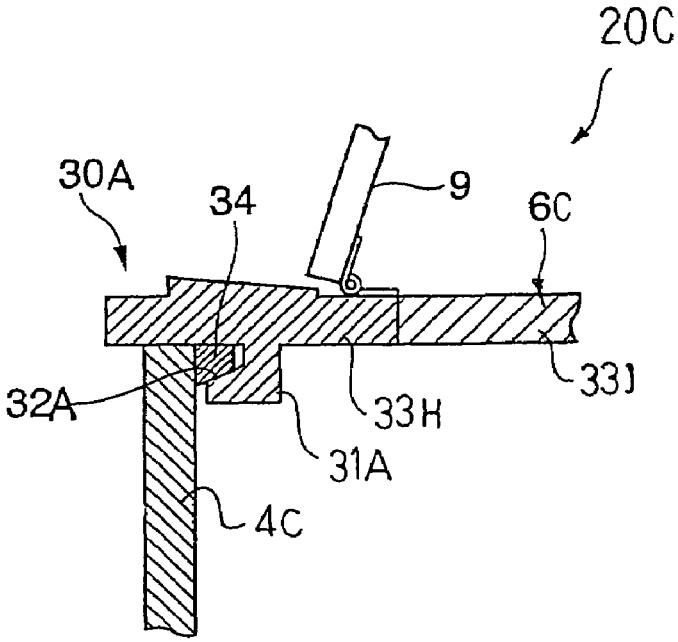
FIG. 5 is a cross sectional view showing the structure of yet another mortise and tenon joint incorporated in still another keyboard musical instrument according to the present invention.

Turning to FIG. 5 of the drawings, a small-sized acoustic upright piano embodying the present invention largely comprises a piano cabinet 20C, a keyboard (not shown) and a tone generating system (not shown). The keyboard and tone generating system are same as those of a standard acoustic piano, and no further description is hereinafter incorporated for the sake of simplicity.

The piano cabinet 20C is similar to the piano cabinet 20A (see FIG. 3) except a mortise and tenon joint 30A. For this reason, description is focused on the mortise and tenon joint 30A. The top board 6C includes a desk board 33H and a rear board 33J, and the desk board 33H is coupled to the front board 4C by means of the mortise and tenon joint 30A. The mortise and tenon joint 30A includes a socket 31A and a tenon 34. A mortise 32A is defined in the socket 31A. The tenon 34 is shaped like a wedge, and the mortise 32A is decreased in cross section toward the bottom.

In the assembling work, an assembling worker aligns the mortise 32A with the tenon 34, and pushes the top board 6C toward the front board 4C. The tenon 34 proceeds toward the bottom of the mortise 32A, and is tightly pressed to the inner surfaces defining the mortise 32A. If the tenon 34 and mortise 32A are exactly shaped, the mortise and tenon joint 30A makes the top board 6C stop at the target position, because the wedged mortise 32A does not permit the wedged tenon 34 to proceed therein. Thus, the top board 6C is positioned at the target position without any adjuster.

As will be appreciated from the foregoing description, the mortise and tenon joints 21, 30, 21B and 30A make the appearance of the cabinets 20, 20A, 20B and 20C fine and the assembling work easy and speedy.

Although particular embodiments of the present invention have been shown and described, it will be apparent to those skilled in the art that various changes and modifications may be made without departing from the spirit and scope of the present invention.

For example, the electronic grand piano does not set any limit on the technical scope of the present invention. The present invention is applicable to keyboard musical instruments of other sorts such as, for example, electronic upright pianos, acoustic grand pianos, acoustic upright pianos, mute pianos, automatic player pianos, organs, harpsichords and celesta.

Each tenon 22, 24A, 22B or 34 may be split into plural blocks, which project from the board at intervals. If the tenon 21 is split into three blocks, the three blocks would project from the center area and both side areas of the rear surface of the front board 4.

The tenon 22, 24A, 22B or 34 may project from the top board. In this instance, the front board 4, 4A, 4B or 4C is formed with the mortise 24, 32, 24B or 32A.

In case where the boards are made of synthetic resin, metal or alloy, the tenon may be molded together with the board. If the board is made of wood, the tenon may be shaped from a part of the board. The filler 25 may be adhered to the outer surfaces of the tenon 22.

A mortise may be open at both sides thereof, at the lower end as well as both sides or only at the front end thereof.

The desk board 33*a* and rear board 33*b* may be monolithic. In case where the boards 33*a* and 33*b* are made of synthetic resin, light metal or light metal alloy, the desk board 33*a* and rear board 33*b* may be molded together.

The adjuster 35 may project through the socket 31 into the mortise 32. In this instance, the tenon 24A is brought into contact with the head of the adjuster 35 when the top board 6A is assembled with the front board 4A.

The front boards 4, 4A, 4B and 4C do not set any limit to the technical scope of the present invention. The top boards 6, 6A, 6B and 6C may be coupled with one of the side boards through the mortise and tenon joints.

The top board 6/6A/6B/6C may be anchored at another board such as, for example, the side board 3/3A.

The music rack does not set any limit to the technical scope of the present invention. A cabinet according to the present invention does not have any music rack, and another cabinet has a fall board formed with a music rack.

The angle 7 does not set any limit to the technical scope of the present invention. A block may be secured to the rear surface of the top board 6 along the rear end. The block and rear board 6 may have a monolithic structure. In this instance, the bolts 5B are screwed through the rear board into the block so that the top board 6 is secured to the rear board.

Claim languages are correlated with the components of the keyboard musical instruments implementing the first to fourth embodiments as follows. The cabinets 20 and 20B and piano cabinets 20A and 20C serve as "cabinet", and the front board 4/4A/4B/4C, side boards 3/3A, rear board (not shown) and rear posts 2B are corresponding to "other component members". In the first to fourth embodiments, the front board serves as "at least one of the other component members". The terms "tone generating system" and "music rack" have been already described hereinbefore.

The angle 7 and bolts 5B as a whole constitute "coupling device", and the rear board serves as "another of the other component members" in the first to fourth embodiments.

What is claimed is:

1. A keyboard musical instrument for generating tones, comprising:

a cabinet formed from a top board defining an upper extent thereof and other component members defining other extents thereof, said top board being connected to at least one of said other component members through a mortise and tenon joint;

a keyboard provided on said cabinet;

a tone generating system housed in said cabinet, and connected to said keyboard for generating said tones; and wherein said top board includes a desk board and a rear board, and said desk board includes at least one of a mortise and a tenon of said mortise and tenon joint.

2. The keyboard musical instrument as set forth in claim 1, in which said mortise and tenon joint has said tenon projecting from one of said top board and said at least one of said other component members, and said mortise formed in the other of said top board and said at least one of said other component members.

3. The keyboard musical instrument as set forth in claim 2, in which said tenon and said mortise have a rectangular parallelepiped configuration.

4. The keyboard musical instrument as set forth in claim 2, in which said tenon and said mortise have a trapezoidal configuration.

5. The keyboard musical instrument as set forth in claim 2, in which said tenon and said mortise have a wedged configuration.

6. The keyboard musical instrument as set forth in claim 2, in which said mortise and tenon joint further has an adjuster projectable from and retractable into one of said tenon and said top board so that a relative position between said top board and said at least one of said component members is controllable by using said adjuster.

7. The keyboard musical instrument as set forth in claim 2, in which said tenon is secured to one of said top board and said at least one of said other component members.

8. The keyboard musical instrument as set forth in claim 1, further comprising a music rack provided on said top board.

9. The keyboard musical instrument as set forth in claim 8, in which said music rack includes a back board projecting from said desk board.

10. The keyboard musical instrument as set forth in claim 9, in which said desk board has an area rearward sloped and defined in front of said back board.

11. The keyboard musical instrument as set forth in claim 1, in which said top board is further connected to another of said other component members by means of a coupling device.

12. The keyboard musical instrument as set forth in claim 11, in which said coupling device includes a bar secured to said top board and bolts screwed through said bar into said another of said other component members.

13. The keyboard musical instrument as set forth in claim 1, in which said at least one of said other component members defines part of a front extent of said cabinet.

14. A keyboard musical instrument for generating tones, comprising:

a cabinet formed from a top board defining an upper extent thereof and other component members defining other extents thereof, said top board being connected to at least one of said other component members through a mortise and tenon joint;

a keyboard provided on said cabinet;

a tone generating system housed in said cabinet, and connected to said keyboard for generating said tones;

wherein said at least one of said other component members and another of said other component members define part of an front extent of said cabinet and part of a rear extent of said cabinet, respectively, and said top board is further connected to said another of said other component members by means of a coupling device.

15. The keyboard musical instrument as set forth in claim 14, further comprising a music rack so as to permit a player to stand a document thereagainst.

16. The keyboard musical instrument as set forth in claim 15, in which said music rack includes a desk board, and said desk board forms a part of said top board.

17. A keyboard musical instrument for generating tones, comprising:

a cabinet formed from a top board defining an upper extent thereof and other component members defining other extents thereof, said top board being connected to at least one of said other component members through a mortise and tenon joint;

a keyboard provided on said cabinet;

a tone generating system housed in said cabinet, and connected to said keyboard for generating said tones; and wherein a tenon of the mortise and tenon joint projects from at least one of a rear surface of said top board and a rear surface of said at least one of said other component members.

18. The keyboard musical instrument as set forth in claim 1, wherein said desk board includes a lateral groove and said rear board of said top board is disposed in said lateral groove.

* * * * *